US008167637B1

(12) United States Patent
Projkovski

(10) Patent No.: US 8,167,637 B1
(45) Date of Patent: May 1, 2012

(54) SHOCK FREE BULB INSERT

(75) Inventor: Joti Projkovski, Naples, FL (US)

(73) Assignee: Joti Projkovski, Naples, FL (US)

( * ) Notice: Subject to any disclaimer, the term of this patent is extended or adjusted under 35 U.S.C. 154(b) by 0 days.

(21) Appl. No.: 12/931,802

(22) Filed: Feb. 11, 2011

(51) Int. Cl.
*H01R 13/625* (2006.01)

(52) U.S. Cl. ..... 439/340; 439/667; 439/700; 439/911

(58) Field of Classification Search ..... 439/339, 439/340, 419, 666, 667, 700, 911
See application file for complete search history.

(56) References Cited

U.S. PATENT DOCUMENTS

| | | | | |
|---|---|---|---|---|
| 4,565,419 | A * | 1/1986 | Johnson et al. | 439/641 |
| 5,380,214 | A * | 1/1995 | Ortega, Jr. | 439/253 |
| 6,322,380 | B1 * | 11/2001 | Conroy | 439/188 |
| 6,491,534 | B1 * | 12/2002 | Bonard et al. | 439/188 |
| 6,536,927 | B1 * | 3/2003 | Lawnicki | 362/448 |
| 7,066,739 | B2 * | 6/2006 | McLeish | 439/39 |
| 7,854,621 | B2 * | 12/2010 | Poulsen | 439/340 |
| 2005/0255718 | A1 * | 11/2005 | McLeish | 439/39 |
| 2007/0167050 | A1 * | 7/2007 | Foo | 439/188 |
| 2009/0029583 | A1 * | 1/2009 | Poulsen | 439/306 |
| 2009/0269961 | A1 * | 10/2009 | Poulsen | 439/340 |

* cited by examiner

*Primary Examiner* — James Harvey
(74) *Attorney, Agent, or Firm* — Werner H. Schroeder

(57) ABSTRACT

The inventive concept is directed to shock free bulb socket that is inserted in an existing light bulb socket to forego any possible electric shock when there is no light bulb in the existing bulb socket and the electric switch happens to be in an "on" status. The insert socket is a housing that is placed over the existing socket and fastened thereto. The insert socket consists of a lower threaded segment that is threaded into the existing socket. There is an upper threaded segment that will receive the light bulb. When the light bulb is threaded into the upper segment it will encounter a plate there below and will cause the upper threaded segment to slide upwardly together with a bracket to which it is attached. There is a sliding hot prong and a sliding neutral prong which will make contact when the bracket moves upwardly and will convey electric current to the light bulb. When the light bulb is removed, springs return the bracket to its original position and the contact between the prongs is discontinued and no shock can be experience when a finger is placed into the light socket.

2 Claims, 2 Drawing Sheets

SHOCK FREE BULB INSERT

BACKGROUND OF THE INVENTION

The invention is directed to an improved light system which incorporates an effective system which greatly reduces the risk of electric shocks and reduces the risk of electrocution by small children. This invention is directed to accessible lamps especially table lamps wherein the bulbs have been removed and the remaining sockets are easily accessible especially for children. In many instances the light switch has been left turned on. If any person, especially children, are tempted to put their fingers into the to the open socket and it is clear that an electric shock will be experienced by that person.

BRIEF DESCRIPTION OF THE INVENTION

The present inventive concept places a socket into the existing light socket which eliminates the central electrical contact point in the original socket as being under an electric source. Only when the bulb is screwed into the replacement socket will contact be made.

DETAILED DESCRIPTION OF THE INVENTION

Figure 1:
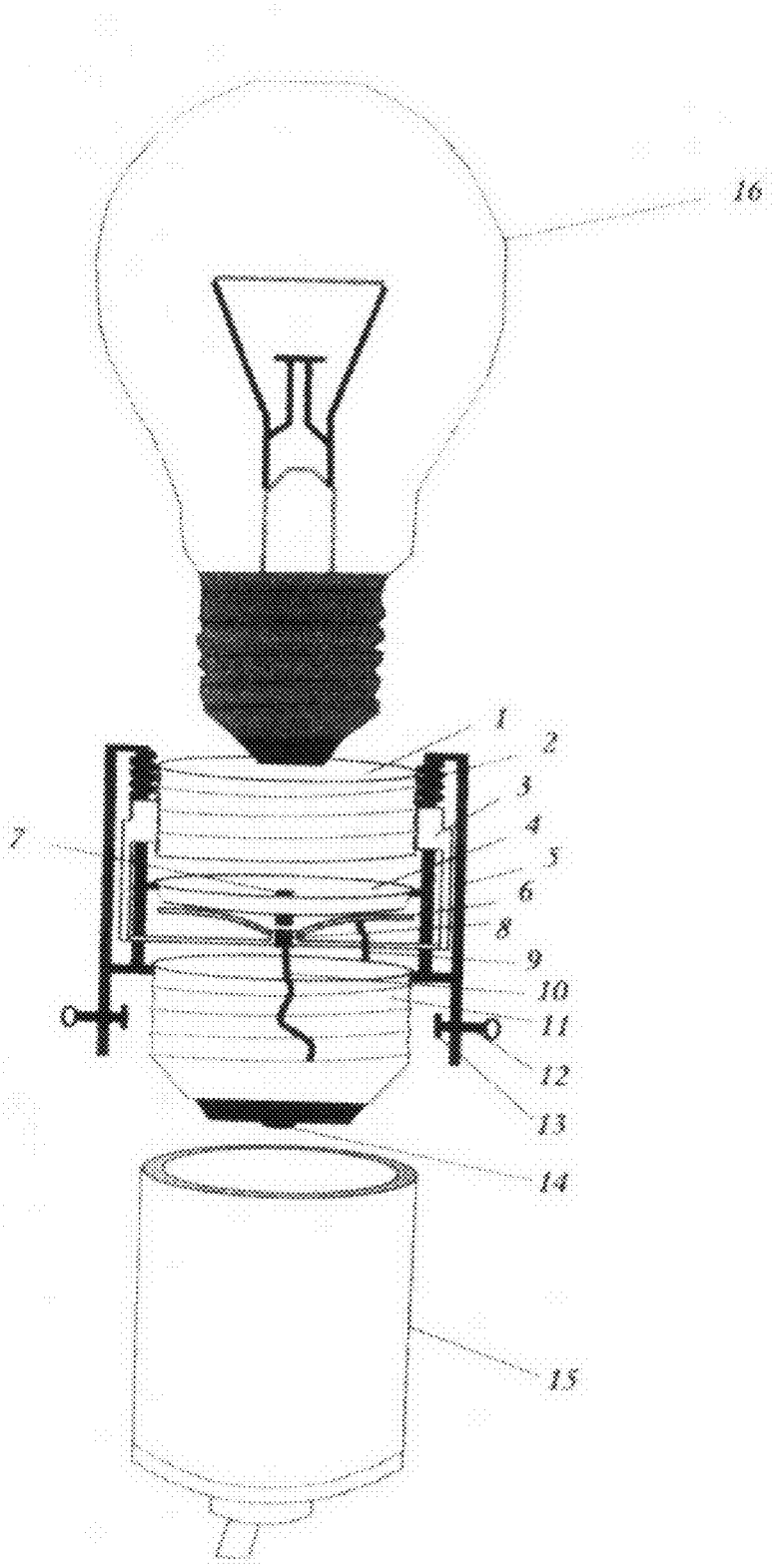
FIG. 1 is an exploded view of the bulb insert and the socket.
Figure 2:
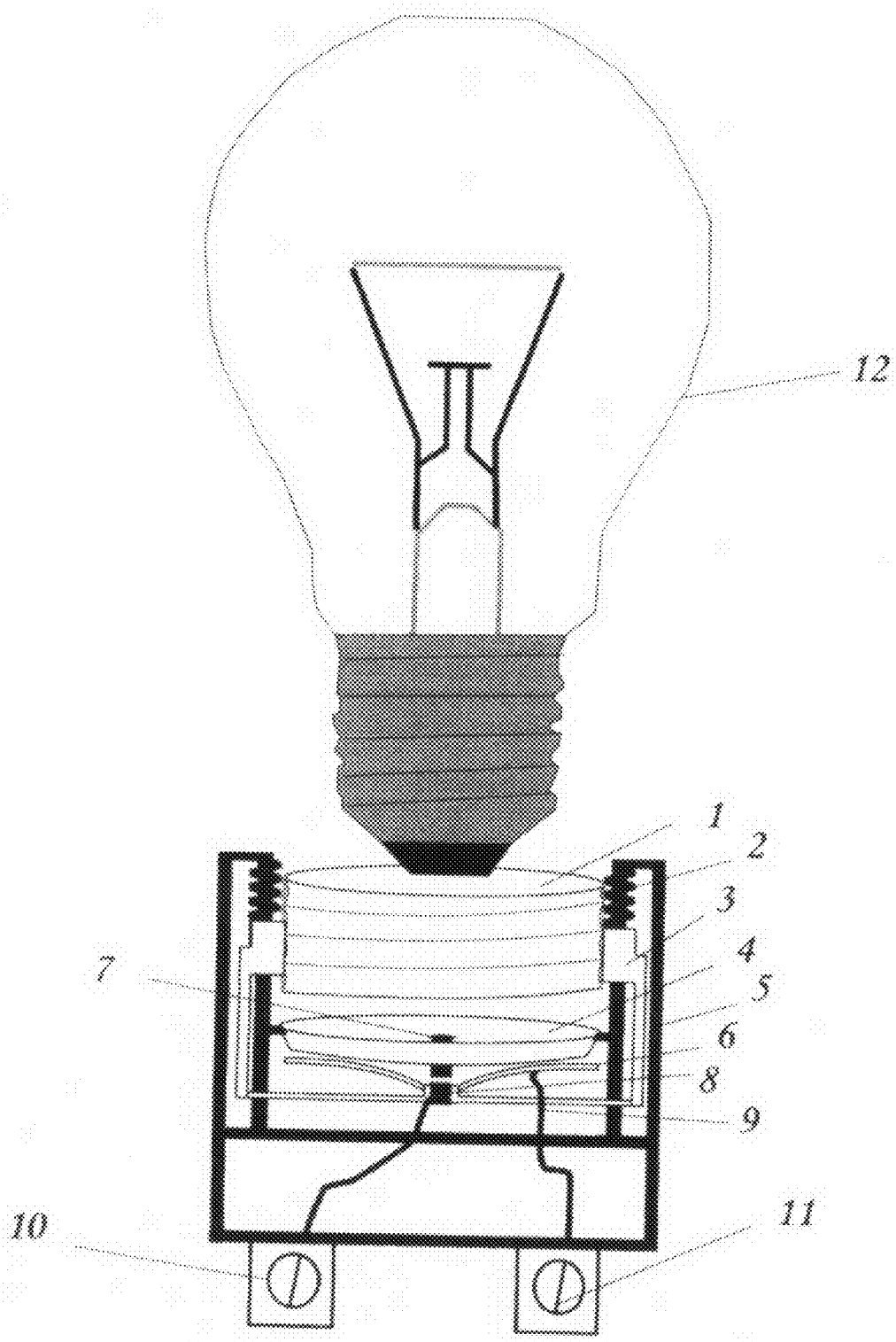
FIG. 2 is an assembled view of the socket.

The insert consists of two segments. There is an upper segment 1 having threads therein. This segment 1 is movable within a housing 5. The housing 5 is installed over the basic light bulb socket 15 and is fastened there against by way of locking bolts having plastic contact points 13 which will seat against the outer circumference of the basic light socket 15. Within the housing 5 there is located a plate 4 which at its center has fastened thereto the light bulb hot contact point or prong 8. A hot wire 10 is connected to the contact point 8 and further connected to the hot prong or point 14 at the bottom of the insert or adapter which will make contact with the hot point in the bottom of the existing lamp socket 15. Within the housing 5 there is plate 4 which is fastened within the housing 5 and this plate has attached thereto, in its center, a hot upper prong contact point 7. The housing 5 also has a sliding bracket installed therein which is under the bias of springs 2. The bracket 3, at its lower end, has a neutral wire attached thereto. The operation of the embodiment will be explained below. With regard to FIG. 2, the shock free bulb socket insert or adapter can also be made as a shock free bulb socket without the use of the lower threads 11 and the locking bolts 12 (FIG. 1) and be hard wired in the factory as an original bulb socket. FIG. 2 illustrates this embodiment and shows the upper threads and the housing 5 including the springs 2 and the various contact points 6, 7, 8 and the hot terminal 1.

OPERATION

As a first step the bulb socket insert will be mounted in an existing bulb socket 15 by threading the lower thread 11 into the existing socket 15. The lower threads are contained and supported by the housing 5 which will be secured against the existing bulb socket by way of the locking bolts 12. Thereafter the bulb is threaded into the upper threads 1 until the bottom of the bulb reaches the plate 4. A continued threading of the light bulb results in the upper threads sliding upwardly together with the bracket 3 and places the springs 2 on an upwardly directed bias and the sliding hot prong 8 and the sliding neutral prong 6. Thereby, the sliding hot prong 8 makes contact with the hot upper prong 7 and the sliding neutral prong 6 makes contact with the plate 4 and energizes the bulb. When the bulb is being unthreaded from the shock free bulb socket, springs 2 push the bracket 3 downwardly together with the upper threads 1 and the sliding hot prong 8 and the sliding neutral prong 6 to thereby de-energize the hot upper prong 7 and the plate 4. Therefore, if the power is "on" in the existing lamp socket 15, it is safe if one gets in contact with the plate 4 or the upper hot prong 7 in the bulb socket insert because there is a disconnect of power.

This even is applicable when the plug from the lamp itself is inserted backwards, that is, reversing the polarity of the power line. Another advantage of using this inventive bulb socket insert is that if the glass of the light bulb breaks in the process of removing it, and the filaments and the internal parts of the bulb are exposed and they remain energized, one can loosen the locking bolts 12 to thereby enable the user to remove the shock free bulb socket from the lamp socket together with the parts that are left from the bulb and remove them safely.

The same principle of operation applies to FIG. 2 where the shock free bulb socket is factory installed because the same sliding parts upon threading the bulb into the socket are present and will operate the same way as was explained with reference to FIG. 1.

What I claim is:

1. A shock free bulb socket insert including a housing which is fastened to an existing bulb socket, said housing having an upper threaded segment and a lower movable section in the form of a bracket, said bracket having contained therein a plate having a hot prong in its center, a sliding neutral prong is located below said plate, a positive electrical contact is made between said hot prong and said sliding prong when a light bulb is threaded into said shock free bulb socket insert; a spring bias being located between said housing and said lower movable bracket, said spring bias being instrumental to return said bracket to a position to disconnect said hot and sliding prongs.

2. The shock free bulb socket insert of claim 1 including a lower threaded section attached to said housing, said lower threaded section being threaded into said existing bulb socket.

* * * * *